US005669251A

United States Patent [19]

Townsend et al.

[11] Patent Number: 5,669,251

[45] Date of Patent: Sep. 23, 1997

[54] LIQUID CARBON DIOXIDE DRY CLEANING SYSTEM HAVING A HYDRAULICALLY POWERED BASKET

[75] Inventors: Carl W. Townsend; Edna M. Purer, both of Los Angeles, Calif.

[73] Assignee: Hughes Aircraft Company, Los Angeles, Calif.

[21] Appl. No.: 688,701

[22] Filed: Jul. 30, 1996

[51] Int. Cl.[6] ..... D06F 43/02

[52] U.S. Cl. ..... 68/58; 68/184

[58] Field of Search ..... 68/58, 140, 184

[56] References Cited

U.S. PATENT DOCUMENTS

| | | | |
|---|---|---|---|
| 1,358,168 | 11/1920 | McCutchen | 68/58 |
| 1,455,378 | 5/1923 | Allen | 68/58 |
| 2,357,909 | 9/1944 | Ridge | 68/58 X |
| 2,816,429 | 12/1957 | Kurlancheek | 68/184 X |
| 3,444,710 | 5/1969 | Gaugler et al. | 68/184 |
| 5,267,455 | 12/1993 | Dewees et al. | 68/5 C |
| 5,467,492 | 11/1995 | Chao et al. | 8/159 |

*Primary Examiner*—Philip R. Coe

*Attorney, Agent, or Firm*—M. E. Lachman; M. W. Sales; W. K. Denson-Low

[57] ABSTRACT

A liquid carbon dioxide dry cleaning system that employs a rotating basket inside a dry cleaning vessel that is powered by hydraulic flow. The present invention is particularly useful as a dry cleaning system that uses liquid carbon dioxide as the cleaning agent. The dry cleaning system has a pressurized vessel containing a liquid carbon dioxide bath. The basket is disposed in the vessel and has a plurality of openings around its periphery. A plurality of roller bearings are disposed between the basket and the vessel that allow it to rotate within the vessel. A plurality of manifolds are disposed between the vessel and the basket that have nozzles that produce jets of liquid carbon dioxide that agitate the garments. The nozzles are aligned with the plurality of openings in the basket. A pump is coupled between the manifolds and the vessel for circulating the liquid carbon dioxide to produce the jets that clean the garments and rotate the basket. Additional sets of manifolds and nozzles and a valve may be provided to cause the basket to selectively counter-rotate.

12 Claims, 3 Drawing Sheets

LIQUID CARBON DIOXIDE DRY CLEANING SYSTEM HAVING A HYDRAULICALLY POWERED BASKET

BACKGROUND

The present invention relates generally to carbon dioxide dry cleaning systems, and more particularly, to a liquid carbon dioxide dry cleaning system employing a hydraulically powered basket.

All currently-available dry cleaning solvents present health and safety risks and are environmentally detrimental. Such dry cleaning solvents include perchloroethylene, which is a suspected carcinogen. Currently-available petroleum based solvents are flammable and produce smog.

Liquid carbon dioxide is an inexpensive and unlimited natural resource, that is non-toxic, non-flammable, and does not produce smog. Liquid carbon dioxide does not damage fabrics, or dissolve common dyes, and exhibits solvating properties typical of hydrocarbon solvents. Its properties make it a good dry cleaning medium for fabrics and garments.

One patent referencing liquid carbon dioxide as a suitable solvent for garment dry cleaning applications is U.S. Pat. No. 4,012,194 issued to Maffei. This patent however, does not address a means of providing mechanical action essential for removal of insoluble soil.

U.S. Pat. No. 5,267,455 issued to Dewees, et at. uses a conventional rotating basket in a pressure vessel, and wherein mechanical action necessary to remove insoluble soil is provided by a technique wherein the garment is immersed into a solvent pool at the bottom of the rotating basket (known as a fall-and-splash technique). However, the fall-and-splash mechanical action produced by the rotating basket, whether achieved by large, magnetically coupled drives, or by a break through shaft, is expensive and has high maintenance costs. In addition to this, cleaning performance of systems using fall-and-splash mechanical action is directly dependent on the density of the cleaning fluid. As such, a fall-and-splash in a low density liquid, such as liquid carbon dioxide, results in lower mechanical action than is achieved in a high density fluid, such as perchloroethylene.

In a liquid carbon dioxide dry cleaning process, as described in an embodiment disclosed in U.S. Pat. No. 5,467,492 issued to Chao, et. at., the mechanical action necessary for soil removal is provided by jet nozzles placed in an appropriate configuration to promote the tumbling action of the garments. In this invention, there are no moving parts in the cleaning vessel. In this invention, the fluid jets have a dual role, which is to agitate the entire load, and to expel particulate soils to clean individual garments within the load. However, although this invention was reduced to practice and the jet cleaning performance was demonstrated, the high power requirement necessary to move the load raises the costs of pumps, plumbing and energy use.

Therefore, it is an objective of the present invention to provide a liquid carbon dioxide dry cleaning system that improves upon the systems disclosed in the above referenced patents, and particularly the system disclosed in the Chao, et al. patent.

SUMMARY OF THE INVENTION

In order to meet the above and other objectives, the present invention provides for a liquid carbon dioxide dry cleaning system that incorporates a rotating basket inside a dry cleaning chamber or vessel that is powered by hydraulic flow, thus eliminating the need for rotating seals and drive shafts. The present invention is particularly useful with dry cleaning systems that utilize liquid carbon dioxide as the cleaning solvent, where high operating pressures makes rotating shaft seals cost-prohibitive.

More specifically, the present dry cleaning system comprises a pressurized vessel containing a liquid carbon dioxide bath. A perforated basket that holds garments that are to be dry cleaned is disposed in the vessel and has a plurality of openings around its periphery. A plurality of roller bearings are disposed between the basket and the vessel that allow the basket to rotate within the vessel. One or more manifolds are disposed between the vessel and the basket that have a plurality of nozzles that produce jets of liquid carbon dioxide that agitate the garments. The plurality of nozzles are aligned with a plurality of openings in the perforated basket. A pump is coupled to the plurality of manifolds and the pressurized vessel for pumping the liquid carbon dioxide to produce the liquid carbon dioxide jets that clean the garments and rotate the basket.

The present invention reduces the power necessary to carry out the dry cleaning process described in U.S. Pat. No. 5,467,492, which utilizes jets of liquid carbon dioxide to provide the mechanical action used for garment cleaning. The reduction in power provides for a more efficient process from the point of view of capital equipment, and in particular the use of a smaller pump, with resultant lower operating costs derived from lower energy requirements and lower maintenance.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
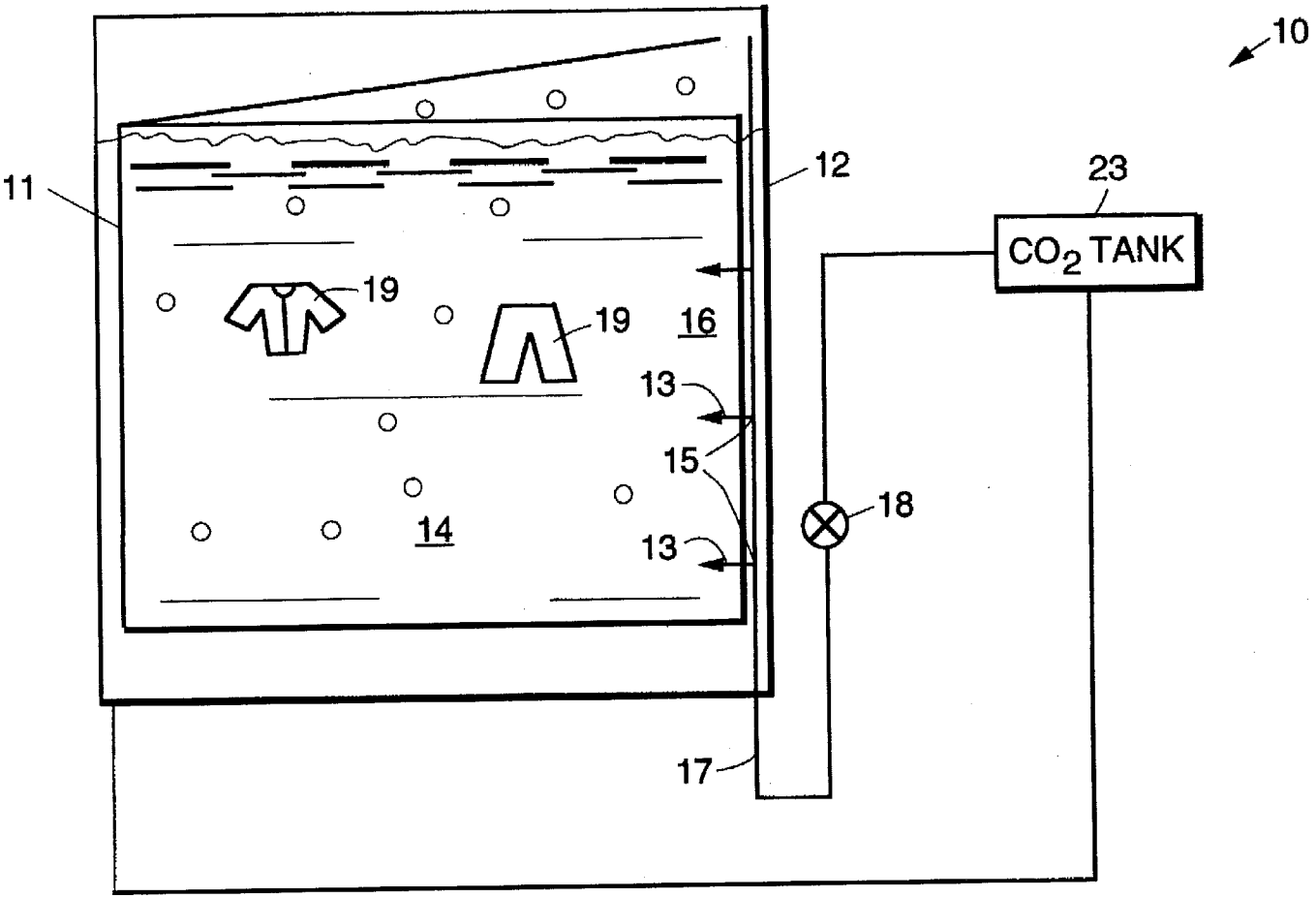
FIG. 1 (PRIOR ART)
FIG. 1 shows a prior art liquid carbon dioxide dry cleaning system that is improved upon by the present invention.

Referring to the drawing figures, FIG. 1 shows a liquid carbon dioxide dry cleaning system 10 described in U.S. Pat. No. 5,467,492 that is improved upon by the present invention. The disclosure of U.S. Pat. No. 5,467,492 is incorporated herein in its entirety. The present invention augments the liquid carbon dioxide jet cleaning system 10 of U.S. Pat. No. 5,467,492, by maintaining its performance and reducing its cost.

Figure 3:
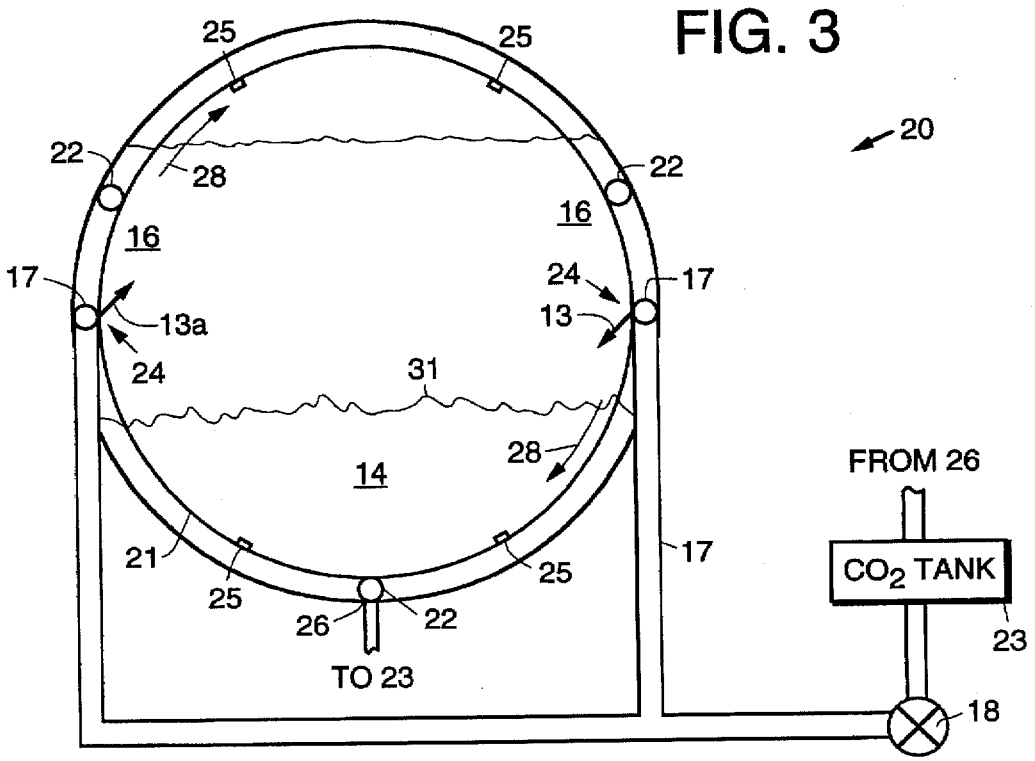
FIG. 3 is an end view of the liquid carbon dioxide dry cleaning system of FIG. 2.

With reference to FIG. 1, which corresponds to FIG. 3 of U.S. Pat. No. 5,467,492, in the liquid carbon dioxide jet cleaning system 10, a load of garments 19 is loaded in an enclosed cylindrical perforated basket 11 disposed inside a pressurized cleaning vessel 12 and submerged in a fluid bath 14 comprising liquid carbon dioxide. The load of garments 19 is set into motion and is agitated by high velocity fluid jets 13 of liquid carbon dioxide. The jets 13 of liquid carbon dioxide are discharged through nozzles 15 disposed in manifolds 17, arranged in an appropriate configuration within the perforated basket 11.

A cleaning zone 16 is at the outermost periphery of the rotating load of garments 19, at or near the jets 13. As the garments 19 enter the high velocity jet cleaning zone 16, they are entrained by the jets 13 through a Venturi effect, and experience a momentary acceleration. As a result of this acceleration, the garments 19 stretch. As the garments 19 exit the jets 13, or cleaning zone 16, they relax. This "stretch-relax" cycle repeats itself throughout the entire cleaning process. While in the stretched position, a portion of the momentum of each fluid jet 13 is transferred to pigment soil in the garments 19, resulting in expulsion of the soil from the garments 19.

In order to dean the entire load of garments 19, it must be set and maintained in motion by the fluid jets 13, such that each individual garment 19 spans the jet cleaning zone 16 an adequate number of times to expose all surfaces that are to be cleaned to the jets 13. Also, an adequate pressure drop across the nozzles 15 is required to generate the stretch acceleration necessary for soil removal.

Power for the process originates in a pump 18 and is transferred to the load of garments 19 as follows. The pump 18 supplies power and produces a differential pressure across the nozzles 15 to generate fluid velocity. The fluid velocity in turn produces fluid momentum which results in soil expulsion from the garments 19.

A more detailed understanding of this prior art liquid carbon dioxide jet cleaning system 10 may be had from a reading of U.S. Pat. No. 5,467,492. Further details of the liquid carbon dioxide jet cleaning system 10 of this patent will not be provided herein since they are not necessary for an understanding of the present invention.

The power requirement for the cleaning process used in U.S. Pat. No. 5,467,492 depends on two factors, including the power necessary to move the load of garments 19, and the power necessary to expel individual soil particles. The present invention reduces the fraction of the power needed to move the load of garments 19 and will now be described.

Figure 2:
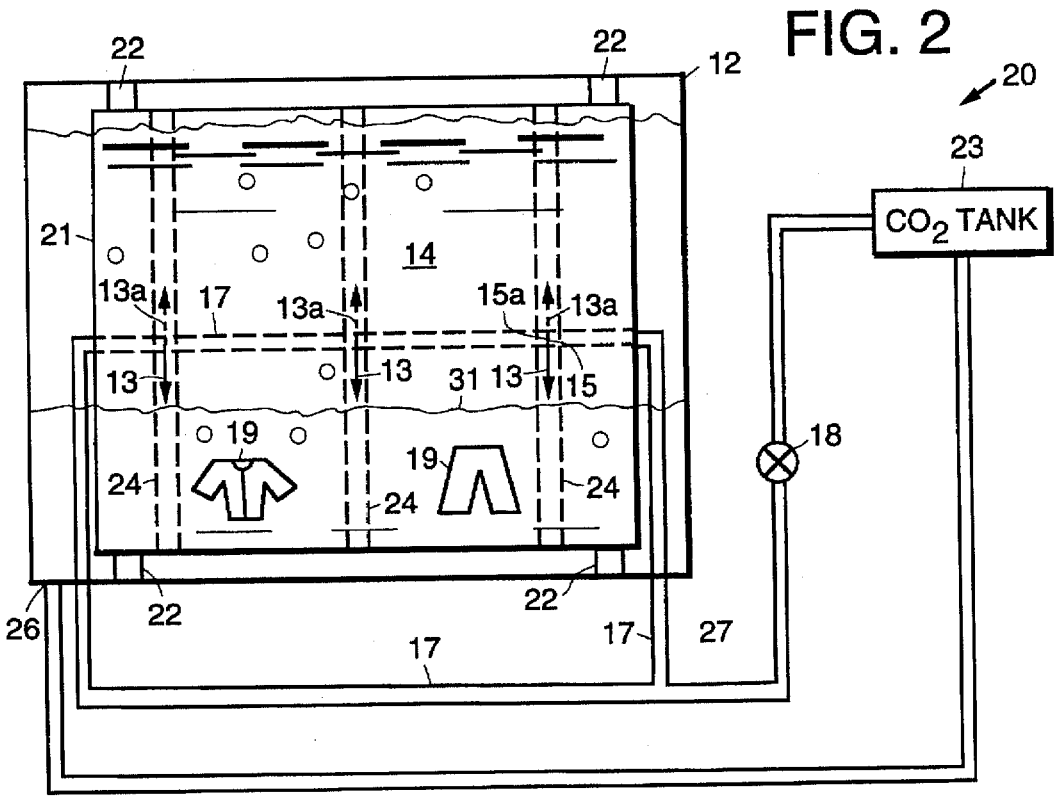
FIG. 2 is a cross sectional side view of a liquid carbon dioxide dry cleaning system employing a hydraulically powered basket in accordance with the principles of the present invention.

Referring to FIG. 2, it illustrates a cross sectional side view of an embodiment of a liquid carbon dioxide dry cleaning system 20 in accordance with the principles of the present invention that employs a hydraulically powered rotatable basket 21. FIG. 3 is an end view of the liquid carbon dioxide dry cleaning system of FIG. 2. A conventional liquid carbon dioxide dry cleaning system 10, such as the system 10 described above and in U.S. Pat. No. 5,467,492, for example, may be adapted to embody the principles of the present invention, and in particular may be adapted to use the hydraulically powered basket 21 illustrated in FIGS. 2, 3 and 4.

In the liquid carbon dioxide dry cleaning system 20, a pressurized cleaning vessel 12 is provided, and the hydraulically powered rotatable basket 21 is disposed in the vessel 12 and is rotatably attached thereto by means of a plurality of roller bearings 22, for example. The basket 21 is also perforated. The rotatable nature of the basket 21 is illustrated by arrows 28 in FIG. 3. A nozzle manifold 17 (or a plurality of manifolds 17) is disposed at a predetermined location between the basket 21 and the vessel 12. The manifold 17 contains a plurality of nozzles 15. The manifold 17 is fed with pressurized liquid carbon dioxide ($CO_2$) by means of a pump 18 that pumps the liquid carbon dioxide from a storage tank 23, for example. Power for the pump 18 is supplied by a motor or other power producing device (not shown). A fluid outlet 26 or drain 26 allows soft-laden liquid carbon dioxide to exit the cleaning vessel 12. Fluid exiting from the cleaning vessel 12 is typically passed through filters (not shown) before returning to the tank 23 and/or pump 18.

The basket 21, which is typically cylindrical, is constructed with slots 24 or openings 24 around the periphery thereof, that are aligned to allow liquid jets 13 to enter the interior of the basket 21. Ribs 25 (FIG. 3) are attached along the length of the basket 21 to provide structural stiffness. Garments 19 disposed within the basket 21 are impacted or entrained by the liquid carbon dioxide jets 13 and are cleaned in the manner described in U.S. Pat. No. 5,467,492. However, in contrast to the teachings of U.S. Pat. No. 5,467,492, the basket 21 is mounted and rotates on the roller bearings 22 to allow it to rotate freely within the pressurized cleaning vessel 12.

A portion of the momentum from the liquid jets 13 entrains the garments 19 and sets them into a rotating, tumbling motion. Friction between the garments 19 and the basket 21 subsequently transfers momentum to the basket 21 and sets it into motion. The motion from the basket 21 allows surfaces of the garments 19 to be brought into contact with the liquid jets 13, thus providing uniform exposure of the garments 19 to the liquid jets 13.

The reduction in power required by the pump 18 for this that is provided by using the present invention may be seen by comparing the system 10 of FIG. 1 (the existing art) and the system 20 of FIG. 2 (the present invention). The power requirement for either system 10, 20 depends on two factors, the power necessary to move the load of garments 19, and the power necessary to expel individual soil particles from the garments 19. Mathematically, the power balance may be written as:

Total power=Soil expulsion power+Garment movement power.

In both systems 10, 20, the power required to expel particles is essentially equivalent. Garment movement power, on the other hand, depends on friction, which is quite different for the two systems 10, 20. In the prior art system 10, the moving garments 19 experience friction due to their impact with the stationary wall of the basket 11. This friction dissipates momentum, thus slowing the garments 19 down. For uniform cleaning to occur, sufficient power must constantly be applied to overcome this frictional resistance.

In the present invention, friction between the garments 19 and the rotatable basket 21 causes the basket 21 to rotate. The rotatable basket 21 quickly speeds up until its rate of rotation is equal to the rotation rate of the garments 19. At this point, the friction between the garments 19 and the wall of the basket 21 disappears, leaving only the friction between the basket 21 and the roller bearings 22. Since the friction of the beatings 22 is very small for appropriately chosen bearings 22, the total power needed to conduct the dry cleaning process is just slightly greater than the power needed for soil expulsion only.

Several modifications to the present invention may also be implemented to further improve the present system 20. One modification is to lower the level of the fluid bath 14 in the cleaning vessel 12 to a point where it is about ⅓ full (illustrated as liquid level 31). By keeping the level of the fluid bath 14 low, the nozzles 15 can spray the garments 19 directly without penetrating through the bulk liquid in the cleaning vessel 12. This minimizes friction within the fluid bath 14, thus increasing the particle removal effectiveness. Also, once the garments 19 reach the apex of their motion, they will fall back into the fluid bath 14. This improves the degree of tumbling and load randomization, thus allowing all garment surfaces to be brought to the cleaning zone near the nozzles 15 more rapidly. Under these conditions, the time needed to completely clean the load of garments 19 is reduced.

Another variation of the present invention is to directly transfer momentum from the fluid to the basket 21 by using means such as a paddle wheel 31 or turbine 31. The structural ribs 25 in the basket 21 may be enlarged for this purpose. Under either of these first two variations, the basket 21 is free to rotate at a rate that is faster than the garments 19. In this embodiment, the ribs 25 along the wall of the basket 11 help carry the garments 19 higher before allowing them to fall back into the fluid bath 14.

Figure 4:
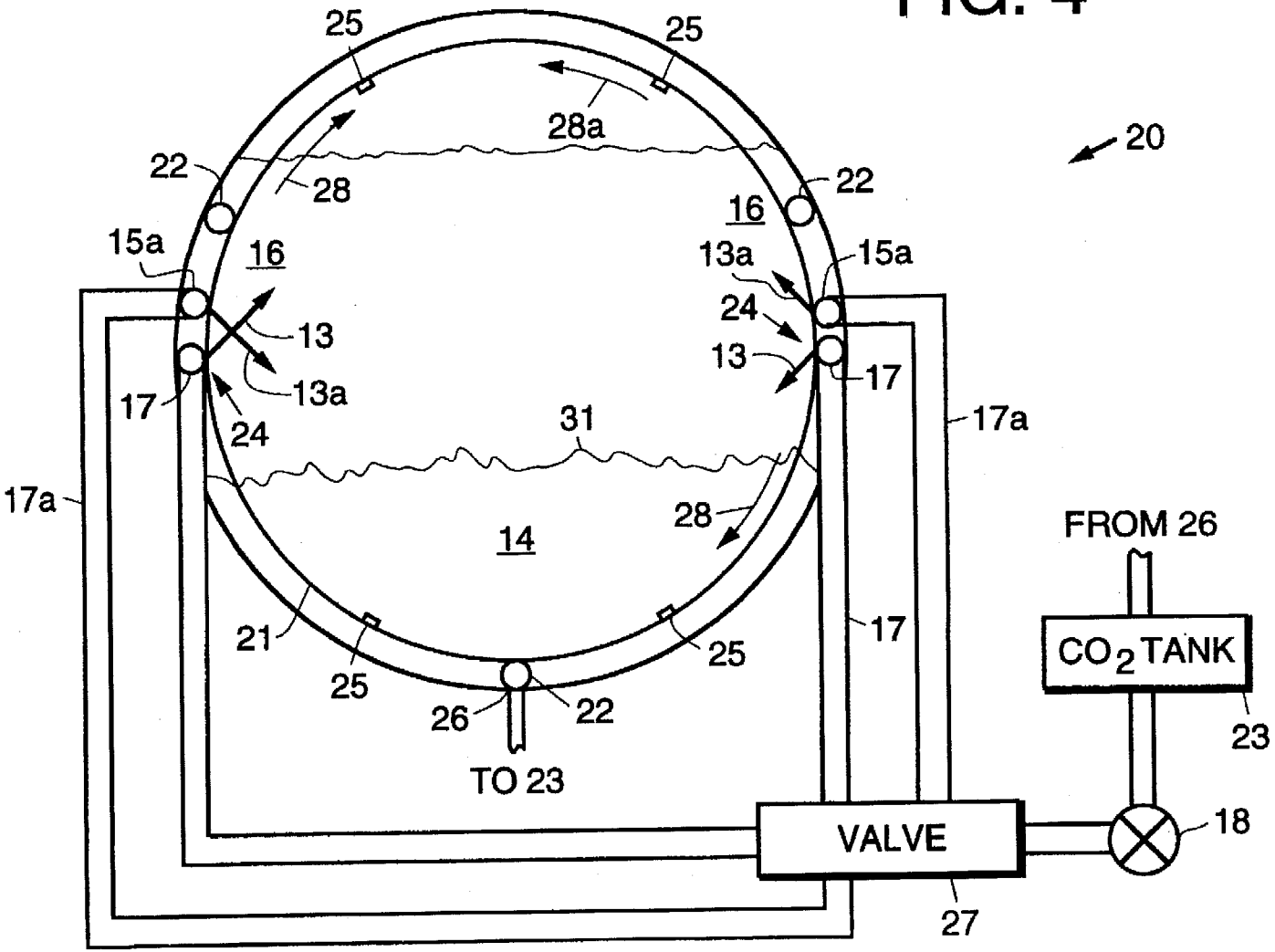
FIG. 4 is an end view of the liquid carbon dioxide dry cleaning system of FIG. 2 which incorporates a variation in which the direction of rotation is periodically reversed.

Referring now to FIG. 4, a third variation is to periodically alter the direction of rotation 28*a* of the basket 21. This may be accomplished by providing a second set of nozzle manifolds 17*a*, such that a second set of nozzles 15*a* point in the opposite direction from the first set of nozzles 15. A valve 27 may be used to switch from one set of manifolds 17 to the other set of manifolds 17*a*. This variation is especially effective when cleaning large garments 19, which would otherwise tend to ball-up. Balled-up garments unwind once the flow of liquid is reversed, thus allowing interior surfaces of the garments 19 to move to the exterior, and allow more uniform cleaning. Additionally, during the transition time when the rotation of the basket 21 is opposite to the jet flow, higher relative velocities are reached, resulting in enhanced particulate removal.

By combining some or all three of the above variations, the extent of tumbling of the load of garments 19 may be optimized by simple experimentation. The relative speed of rotation and hence tumbling may also be adjusted by changing the angle of the nozzles 15. Nozzles 15 adjusted to an angle nearly tangent to the basket 21 provide the fastest rotation. Conversely, adjusting the angle of the nozzles 15 inward slows the rotation rate, and increases the rate of motion of individual garments 19 between the center of the load of garments 19 and the periphery thereof.

The reduction in power required for the pump 18 provided by the present invention results in a direct reduction in size of the pump 18, the size of the pump motor and the amount of electrical power needed to run the motor. Other indirect benefits include reductions in energy, space, cycle time, and cost of equipment needed to conduct the cleaning process. Some of these benefits are as discussed below.

The present invention permits the use of smaller pipe sizes. The power required to pump the liquid is proportional to the flow rate. Reductions in the flow rate allows smaller piping to be used, with a corresponding reduction in capital and installation cost. Substantial cost reductions are also realized from smaller valve sizes. The present invention provides for refrigeration savings. All the power put into the pump 18 eventually is dissipated as heat in the liquid. If a constant temperature process is desired, refrigeration or other heat rejection means are needed. Lower pump power allows the use of a smaller, lower cost refrigeration system.

The present invention also provides for a smaller storage volume. The variation in which a lower liquid level is used allows the use of a smaller storage tank for the liquid 23. A smaller storage tank reduces capital costs and reduces the floor space occupied by the system 20. The present invention also provides for reduced cycle time. By improving the overall agitation of the load, soil expulsion rates are accelerated, thus reducing cycle time. This increases throughput rates of the system 20.

Thus there has been described a new and improved hydraulically powered basket for use in liquid carbon dioxide dry cleaning processes. It is to be understood that the above-described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A liquid carbon dioxide cleaning system for dry cleaning garments, said system comprising:

a pressurized vessel containing a fluid bath comprising liquid carbon dioxide;

a basket for holding the garments that are to be dry cleaned that is disposed within the pressurized vessel and that has a plurality of openings disposed around the periphery thereof;

a plurality of roller bearings disposed between the basket and the pressurized vessel for allowing the basket to rotate within the vessel;

a plurality of manifolds disposed between the pressurized vessel and the basket that each comprise a plurality of nozzles that produce jets of liquid carbon dioxide that agitate the garments, and wherein the nozzles are aligned with the plurality of openings in the basket; and a pump coupled between the manifolds and the pressurized vessel for pumping the liquid carbon dioxide to produce the jets that clean the garments and rotate the basket.

2. The cleaning system of claim 1 wherein the pump is coupled to a motor that is driven thereby.

3. The cleaning system of claim 1 further comprising a plurality of ribs attached to an interior surface of the basket to provide structural stiffness.

4. The cleaning system of claim 3 wherein the plurality of ribs are relatively large to create a turbine effect for directly transferring momentum from the jets to the basket.

5. The cleaning system of claim 1 wherein the basket comprises a cylindrical basket.

6. The cleaning system of claim 1 further comprising a fluid outlet disposed in the vessel for allowing soft-laden liquid carbon dioxide to exit the vessel.

7. The cleaning system of claim 1 wherein the level of the fluid bath in the cleaning vessel is maintained at a level that is about ⅓ full.

8. The cleaning system of claim 1 further comprising:

a second set of manifolds disposed such that its nozzles point in a direction opposite to the nozzles; and a valve for switching the manifolds to the second set of manifolds to change the direction of rotation of the basket.

9. A liquid carbon dioxide cleaning system for dry cleaning garments, said system comprising:

a pressurized vessel containing a fluid bath comprising liquid carbon dioxide;

a cylindrical basket for holding the garments that are to be dry cleaned disposed within the pressurized vessel and that has a plurality of openings disposed around the periphery thereof, and that has a plurality of ribs that provide structural stiffness;

a plurality of roller bearings disposed between the cylindrical basket and the vessel for allowing the basket to rotate within the vessel;

a plurality of manifolds disposed between the pressurized vessel and the cylindrical basket that each comprise a plurality of nozzles that produce jets of liquid carbon dioxide that agitate the garments, and that are aligned with the plurality of openings in the cylindrical basket; and a pump coupled between the manifolds and the vessel for pumping the liquid carbon dioxide to produce the jets that clean the garments and rotate the basket.

10. The cleaning system of claim 9 further comprising a fluid outlet disposed in the vessel for allowing soft-laden liquid carbon dioxide to exit the vessel.

11. The cleaning system of claim 9 wherein the plurality of ribs are relatively large to create a turbine effect for directly transferring momentum from the jets to the basket.

12. The cleaning system of claim 9 further comprising:

a second set of manifolds comprising a second set of nozzles point in a direction opposite to the nozzles; and a valve for switching the manifolds to the second set of nozzles to change the direction of rotation of the basket.

* * * * *